US008365346B2

(12) United States Patent
Coppola et al.

(10) Patent No.: US 8,365,346 B2
(45) Date of Patent: Feb. 5, 2013

(54) MULTI-PURPOSE VACUUM UNIT

(75) Inventors: John R. Coppola, Sparta, NJ (US); Frank G. Coppola, Harrington Park, NJ (US)

(73) Assignee: EcoTech Service Co., LLC, Sparta, NJ (US)

( * ) Notice: Subject to any disclaimer, the term of this patent is extended or adjusted under 35 U.S.C. 154(b) by 750 days.

(21) Appl. No.: 12/316,662

(22) Filed: Dec. 15, 2008

(65) Prior Publication Data

US 2010/0147331 A1 Jun. 17, 2010

(51) Int. Cl.
*A47L 7/00* (2006.01)

(52) U.S. Cl. ..... 15/320; 15/321

(58) Field of Classification Search ..... 15/320, 15/302, 339, 300.1; 134/10, 21
See application file for complete search history.

(56) References Cited

U.S. PATENT DOCUMENTS 2,149,453 A 3/1939 Longshore et al.
2,930,055 A * 3/1960 Fallen et al. ..... 15/4
3,197,798 A 8/1965 Brown et al.
3,213,481 A 10/1965 Minerley
3,273,193 A 9/1966 Soderholm et al.
3,675,267 A 7/1972 Klawitter
3,678,534 A 7/1972 Hilbig
3,708,823 A 1/1973 Bell
3,819,069 A 6/1974 Bauman et al.
3,886,624 A 6/1975 Landesman et al.
3,942,214 A 3/1976 Maasberg
3,955,236 A 5/1976 Mekelburg
4,158,901 A 6/1979 Wulff et al.
4,160,302 A 7/1979 Hirst et al.
4,168,562 A 9/1979 Maasberg
4,171,551 A 10/1979 Hildebrand et al.
4,178,647 A 12/1979 Wolynec et al.
4,198,724 A * 4/1980 Fisher et al. ..... 15/302
4,200,950 A 5/1980 Coverley
4,222,141 A 9/1980 Kieft et al.
4,226,034 A 10/1980 Benjamin et al.
4,227,893 A 10/1980 Shaddock
4,236,756 A 12/1980 Hildebrand et al.
4,272,861 A 6/1981 Notta et al.
4,282,626 A 8/1981 Schneider
4,327,455 A 5/1982 Burgoon
4,328,603 A 5/1982 Dickson et al.
4,335,486 A 6/1982 Kochte
4,343,060 A 8/1982 Hildebrand et al.
4,363,152 A 12/1982 Karpanty
4,406,596 A 9/1983 Budde
4,429,433 A 2/1984 Burgoon
4,457,036 A 7/1984 Carlson et al.
4,457,043 A 7/1984 Oeberg et al.
4,460,186 A 7/1984 Hildebrand et al.
4,475,264 A 10/1984 Schulz
4,554,701 A 11/1985 Van Raaij
4,807,327 A 2/1989 Jajko et al.

(Continued)

*Primary Examiner* — Robert Scruggs
(74) *Attorney, Agent, or Firm* — Lerner, David, Littenberg, Krumholz & Mentlik, LLP

(57) ABSTRACT

A suction apparatus for retrieving liquids such as aircraft deicing fluid from a paved surface. The apparatus may have a squeegee structure with multiple inlets for fluid, and a fluid flow structure which can selectively connect only certain inlets to a suction tank. A large inlet can be used in deep fluids, whereas multiple smaller inlets can be used to retrieve a shallow layer of liquid. The inlets may be adjustable relative to the squeegee structure. The apparatus may be mounted on a trailer, and the trailer may be equipped with a hitch that can maintain the trailer in a predetermined level attitude regardless of the height of the hitch on the towing vehicle.

12 Claims, 6 Drawing Sheets

U.S. PATENT DOCUMENTS

| | | | | |
|---|---|---|---|---|
| 4,827,637 | A | 5/1989 | Kahlbacher | |
| 4,845,801 | A | 7/1989 | Milly et al. | |
| 4,879,784 | A | 11/1989 | Shero | |
| 4,884,313 | A | 12/1989 | Zoni | |
| 5,134,748 | A | 8/1992 | Lynn | |
| 5,192,435 | A | 3/1993 | Francisco, Jr. | |
| 5,218,737 | A | 6/1993 | Dansby et al. | |
| 5,224,236 | A | 7/1993 | Sallquist | |
| 5,226,757 | A | 7/1993 | Tarrant | |
| 5,239,720 | A | 8/1993 | Wood et al. | |
| 5,251,652 | A | 10/1993 | Strauser et al. | |
| 5,317,783 | A | 6/1994 | Williamson | |
| 5,331,713 | A | 7/1994 | Tipton | |
| 5,406,673 | A | 4/1995 | Bradd et al. | |
| 5,460,657 | A | 10/1995 | Ally | |
| 5,561,921 | A | 10/1996 | Vanderlinden et al. | |
| 5,596,788 | A | 1/1997 | Linville et al. | |
| 5,630,247 | A | 5/1997 | Venia | |
| 5,630,286 | A | 5/1997 | Vanderlinden et al. | |
| 5,797,203 | A | 8/1998 | Vanderlinden et al. | |
| 5,839,157 | A | 11/1998 | Strauser et al. | |
| 5,934,731 | A | 8/1999 | Routledge | |
| 5,996,171 | A | 12/1999 | Bowers | |
| 6,039,817 | A * | 3/2000 | Payne | 134/21 |
| 6,092,261 | A | 7/2000 | Boomgaarden | |
| 6,189,179 | B1 | 2/2001 | Baird | |
| 6,381,801 | B1 | 5/2002 | Clemons, Sr. | |
| 6,519,808 | B2 | 2/2003 | Legatt et al. | |
| 6,581,239 | B1 | 6/2003 | Dyson et al. | |
| 6,634,719 | B1 | 10/2003 | Monroe | |
| 6,640,383 | B2 | 11/2003 | Tsen | |
| 6,779,823 | B1 | 8/2004 | Fisher, Jr. | |
| 6,845,570 | B2 | 1/2005 | Paterson | |
| 6,904,708 | B2 | 6/2005 | Rogers | |
| 7,238,243 | B2 | 7/2007 | Brantley et al. | |
| 7,254,867 | B2 | 8/2007 | Legatt et al. | |
| 7,281,296 | B2 | 10/2007 | Strauser | |
| 7,287,298 | B2 | 10/2007 | Shinler | |
| 7,287,299 | B2 | 10/2007 | Joynt | |
| 7,290,307 | B1 | 11/2007 | Chao | |
| 2002/0007529 | A1 * | 1/2002 | Legatt et al. | 15/401 |
| 2006/0185689 | A1 * | 8/2006 | Crocker | 134/10 |

* cited by examiner

MULTI-PURPOSE VACUUM UNIT

BACKGROUND OF THE INVENTION

It is often necessary to remove liquids from paved surfaces. In particular, it is presently the practice to de-ice aircraft by spraying the aircraft with deicing liquids such as glycols while the aircraft are parked on a paved surface such as a taxiway or ramp. The liquid which drains from the aircraft accumulates on the paved surface. This liquid must be collected so that it does not run into storm drains or off the pavement and into the ground water.

It has been proposed heretofore to use a high-powered vacuum cleaner mounted on a special-purpose truck chassis with its own motive power to collect the liquid. Units which have been available prior to the present invention have required very powerful suction units, which are costly to build and to operate. The special-purpose truck chassis, with its own power train, adds further cost. Attempts have been made heretofore to use suction cleaning units mounted on trailers which can be pulled by an ordinary truck. Moreover, the fluids tend to accumulate on the pavement in uneven pools, with shallow and deep portions. The suction cleaner may work well on deep liquid as, for example, a pool more than an inch deep, but work poorly on shallow liquid or vice-versa.

Accordingly, there have been needs for further improvements.

BRIEF SUMMARY OF THE INVENTION

One aspect of the invention provides an apparatus for suctioning fluid from a hard surface. Apparatus according to this aspect of the invention desirably includes a squeegee structure defining a collection space, the squeegee structure being movable across the hard surface and adapted to collect fluid from the hard surface in the collection space. A plurality of vacuum inlets communicate with the collection space. The apparatus desirably include a collection tank and a suction pump connected to the collection tank. The apparatus also desirably incorporates a fluid flow structure including one or more conduits. Most preferably, the fluid flow structure is constructed and arranged to connect only one or more selected ones of the inlets to the tank. As further explained below, the ability to use different inlets under different conditions facilitates efficient operation on both deep and shallow liquid pools.

It is a further object of the present invention to provide an apparatus for vacuuming fluid from a hard surface that is towable behind a vehicle. The apparatus desirably includes a trailer frame having a forward end, a rear end and main wheels mounted thereon between the ends. The apparatus desirably also includes one or more hitch units, at least one of which is adapted to connect a hitch on a towing vehicle to the front end of the frame while maintaining the frame in a predetermined attitude with respect to the ground regardless of the height of the hitch on the towing vehicle. The apparatus desirably also includes a suction apparatus having a squeegee structure linked to the trailer frame and a vacuum unit connected to the squeegee structure for drawing fluid from the squeegee structure. The ability to use towing vehicles having different hitch heights provides operating versatility. This feature is particularly useful in the airport environment, where various special-purpose vehicles commonly are available.

Apparatus according to yet a another aspect of includes a squeegee structure defining a collection space, the squeegee structure being movable across the hard surface and adapted to collect fluid from the hard surface in the collection space; a collection tank; a plurality of vacuum inlets communicating with the collection space, one more of the vacuum inlets being movable relative to the squeegee structure; a fluid flow structure including one or more conduits for connecting one or more of the vacuum inlets to the collection tank; and a suction pump connected to the collection tank.

Still further aspects of the invention provide methods for the removal of fluid from a hard surface.

DETAILED DESCRIPTION

Figure 1:
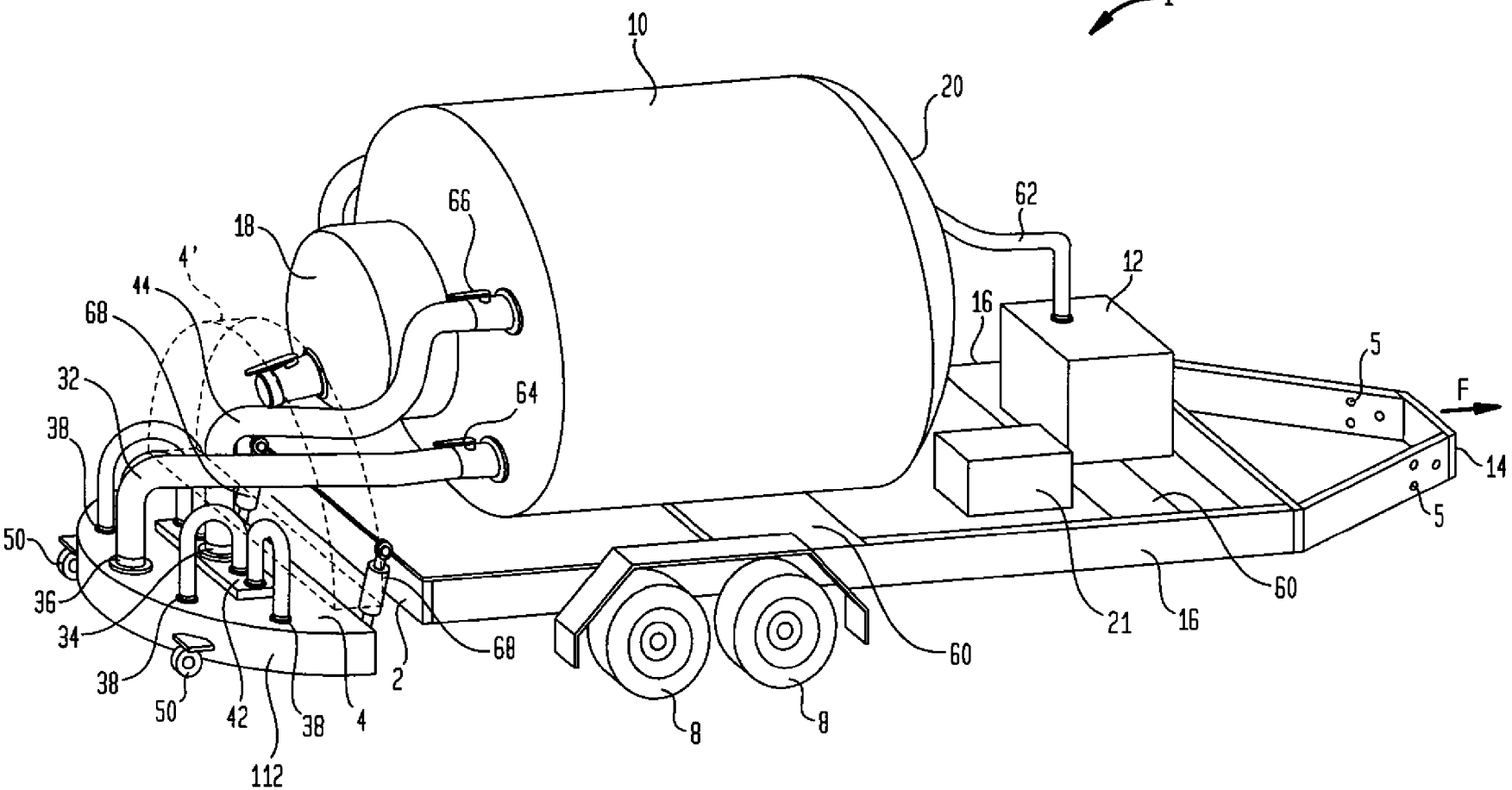
FIG. 1 is a diagrammatic perspective view illustrating a suction cleaner according to one embodiment of the invention.

Apparatus according to one embodiment of the invention (FIG. 1) is intended for suctioning or vacuuming of fluid off of a hard surface. The apparatus can be used to vacuum fluid such as airplane de-icing fluid. The apparatus includes a trailer frame 1 constructed of steel. In this embodiment, the trailer is generally rectangular, but is not limited to this shape. The trailer frame has a front end 14, a rear end 2 and two side members 16 extending between the front and rear ends. Cross members 60 extend between the side members. The lengthwise dimension of the trailer is considerably greater than the height of the trailer frame. Wheels 8 are mounted to the trailer frame, and allow the trailer frame to be pulled over a surface in the forward direction. The side members 16 have attachment sites comprising two sets of holes 5 for the attachment of interchangeable trailer hitch assemblies. In the particular embodiment shown, each set of holes includes three holes.

Figure 6:
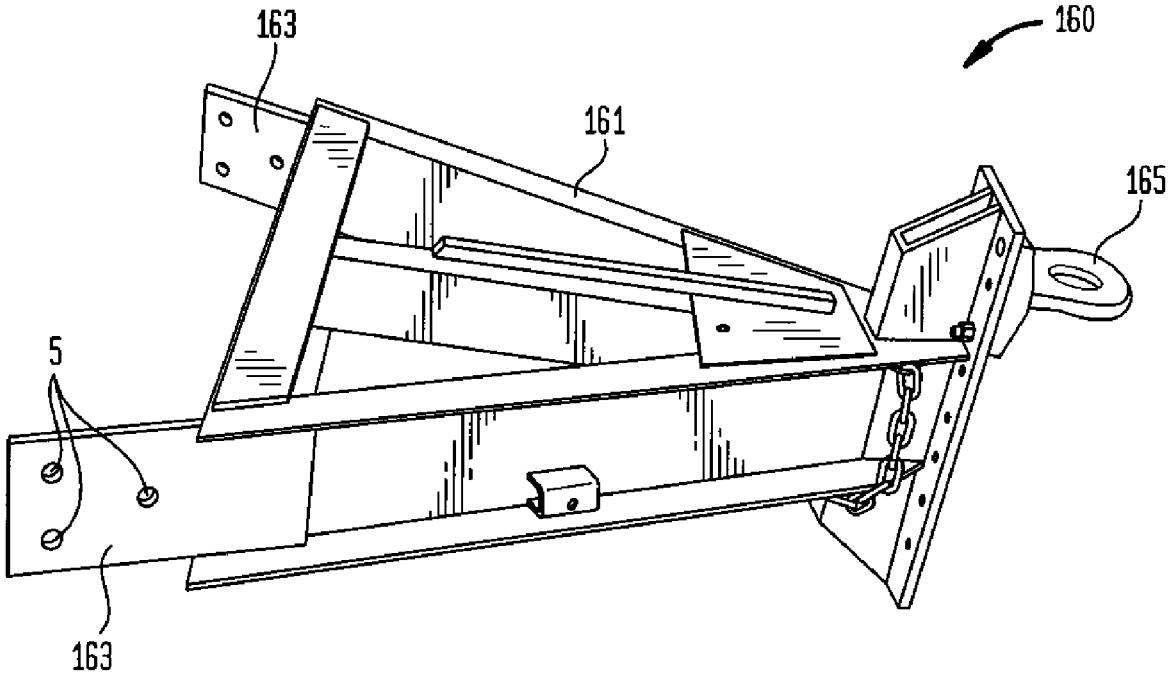
FIG. 6 is perspective view depicting a towing component usable in place of the towing component shown in FIG. 5.

The apparatus includes a first hitch unit 160 (FIG. 6), also referred to herein as a pintle hitch unit. The first hitch unit includes a generally triangular hitch frame 161 having two sets of attachment holes 163 in patterns corresponding to the holes in the attachment sites 5 (FIG. 1) of the trailer frame. The first hitch unit also includes a ring 165 fixed to the forward end of the hitch frame 161. Ring 165 is of an appropriate size to engage a standard hitch on a truck.

Figure 5:
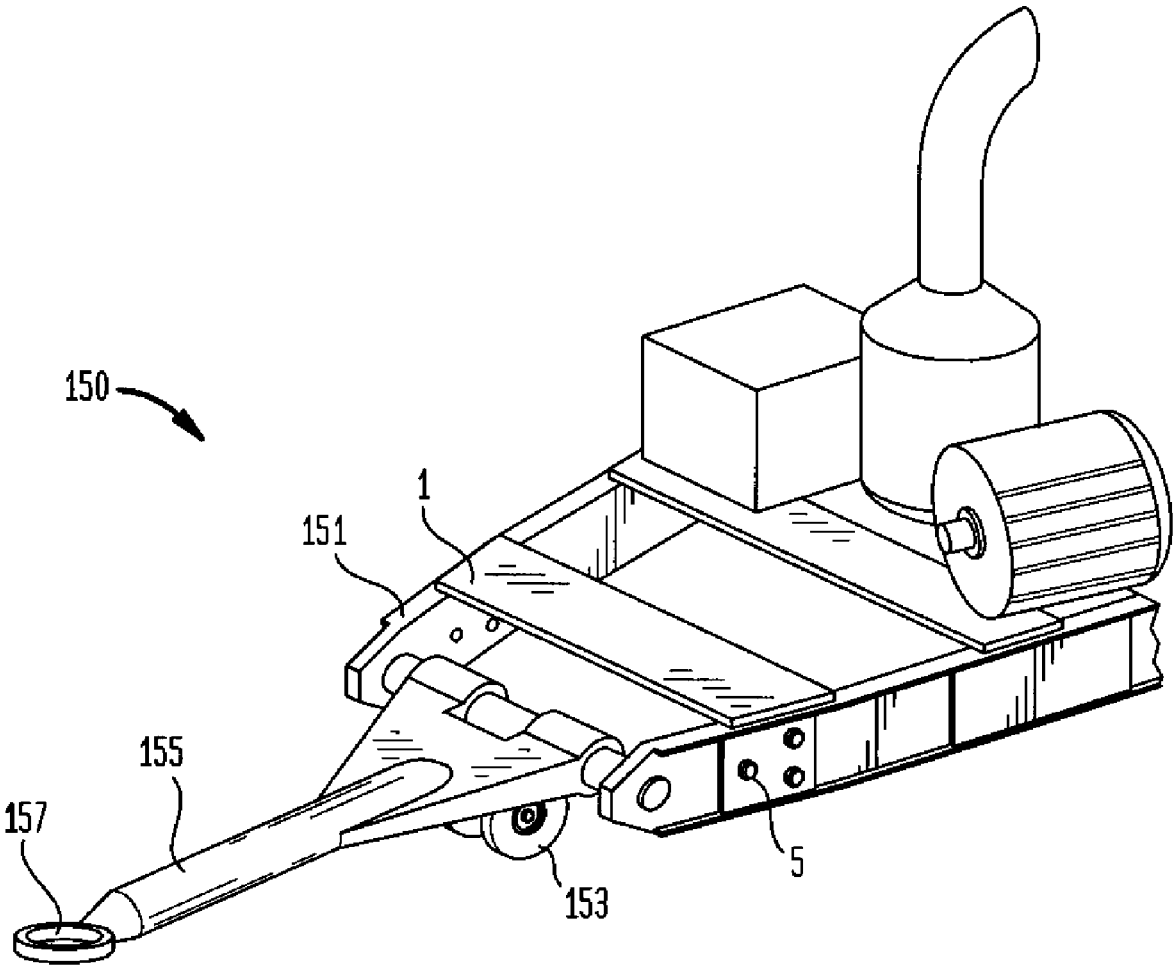
FIG. 5 is a side elevational view of the cleaner shown in FIGS. 1-4 in association a towing component.

The apparatus further includes a second hitch unit 150, (FIG. 5) also referred to herein as a caster hitch unit. The second hitch unit 150 includes a stub frame 151 which also has two sets of attachment holes in patterns corresponding to the holes in the attachment sites 5 of the trailer frame. The second hitch unit includes a steerable wheel set 153 which, in the embodiment depicted includes two small wheels mounted on a common axle. The steerable wheel set is mounted so that the common axle and the wheels can pivot about a vertical axis relative to the stub frame 151. The second hitch unit further includes a component movable in a vertical direction relative to the stub frame 151. In the embodiment depicted, the vertically movable component is an arm 155 which is pivotally mounted to the stub frame 151 at the forward end of the stub frame. Arm 155 has a ring 157 at its forward end, remote from the stub frame. Either the first hitch unit 160 or the second hitch unit 150 can be installed on the forward end of the trailer frame, as by bolts or pins (not shown) extending through the frame of the hitch unit and through the holes 5 at the mounting sites of the trailer frame.

A collection tank 10 is securedly mounted to the trailer frame 1. The tank is cylindrical in shape and is of the type commonly found on septic cleaning trucks. The tank has a circular door 18 at its rear end. The door is normally held closed by clamps (not shown) but can be manually opened by manually releasing the clamps. A dumping mechanism such as a hydraulic dumping mechanism 21 commonly found on dump trucks is mounted to the trailer frame 1 and linked to the tank so that, when the dump mechanism is activated by the operator, the forward portion of the tank 20 raises from the trailer frame allowing for the contents of the tank to flow through the rear door 18 into a suitable waste receptacle. This feature allows the operator to empty the tank easily without coming into contact with the fluid. One or more work lights (not shown) may be mounted to the rear of the tank.

Also attached to the trailer frame 1 is an engine-powered suction pump 12. In the preferred embodiment, the pump is mounted to a support 60 in front of the collection tank 10 but behind the attachment site 5. The suction pump is connected to the interior of tank 10 by a hose 62. As the pump operates, air is drawn from the tank so that suction is generated in tank 10. Suction pump 12 may be a conventional pump of the type commonly used to generate suction in septic-tank cleaning devices as, for example, a pump powered by a 40-50 horsepower engine and capable of pumping 400-500 cubic feet per minute of air.

Figure 2:
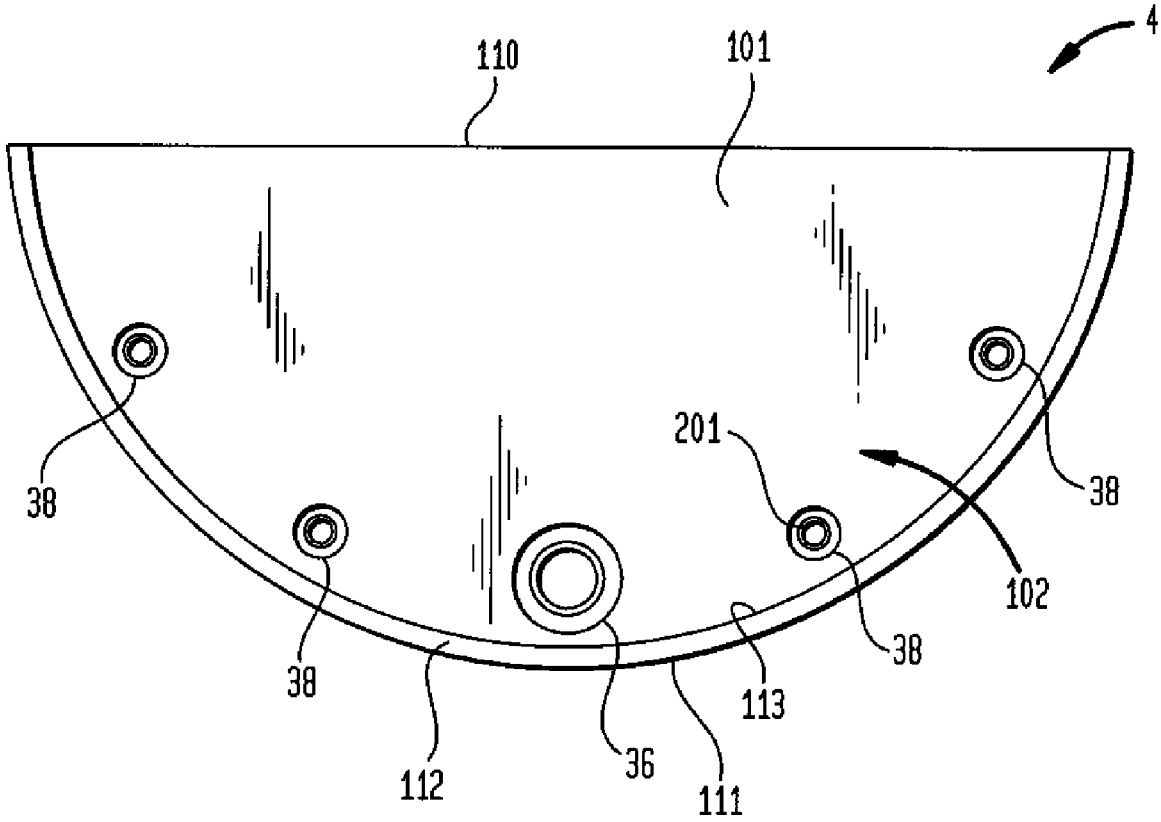
FIG. 2 is a bottom plan view of a component used in the cleaner of FIG. 1.

A squeegee structure 4 is located at the rear of the trailer frame 2. Referring to FIG. 2, in the illustrated embodiment, the squeegee structure 4 includes a top wall 101 (FIGS. 1, 2, 3 and 4] formed from a rigid material such as steel. When the squeegee structure is in the operating position depicted in solid lines in the drawings, top wall 101 is generally horizontal. The other directions and orientations specified herein for elements of the squeegee structure should also be understood as referring to the directions and orientations in the operating position depicted. The top wall is generally shaped like a half-circle with a straight edge at its forward end 110 and a curved border at its rearward end 111. The squeegee structure also includes a rear wall 112 extending downwardly from top wall 101 along the curved rear edge of the top wall, so that the rear wall and top wall cooperatively define a scoop-like structure with a fluid collection space 102 beneath the top wall 101 and in front of the rear wall 112. The squeegee structure is open on its bottom side and on its forward end. The rear wall of the squeegee structure has a height h (FIG. 4) which desirably is a few inches. For example, in a squeegee structure having a top wall in the form of a semicircle of about 96 inches diameter, height h (FIG. 4) may be about 6 inches. The rear wall of the squeegee structure desirably includes a rubber or plastic strip 113 with a beveled edge defining the bottom edge of the rear wall, remote from top wall 101 and used for strip contacting a surface. The squeegee and the rear wall overlap allowing the squeegee to be moved down along the rear wall if its contacting surface breaks down.

Figure 3:
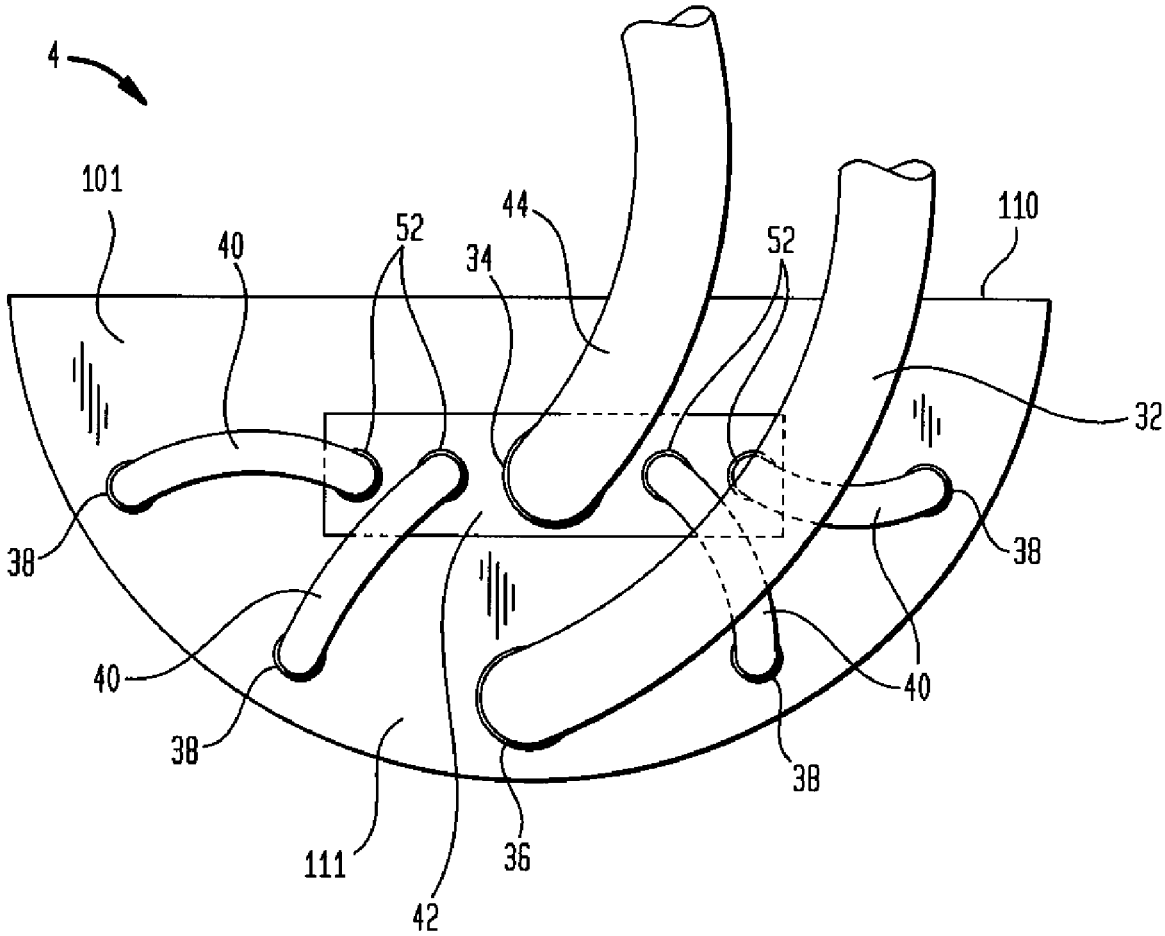
FIG. 3 is a top plan view of the component shown in FIG. 1.
Figure 4:
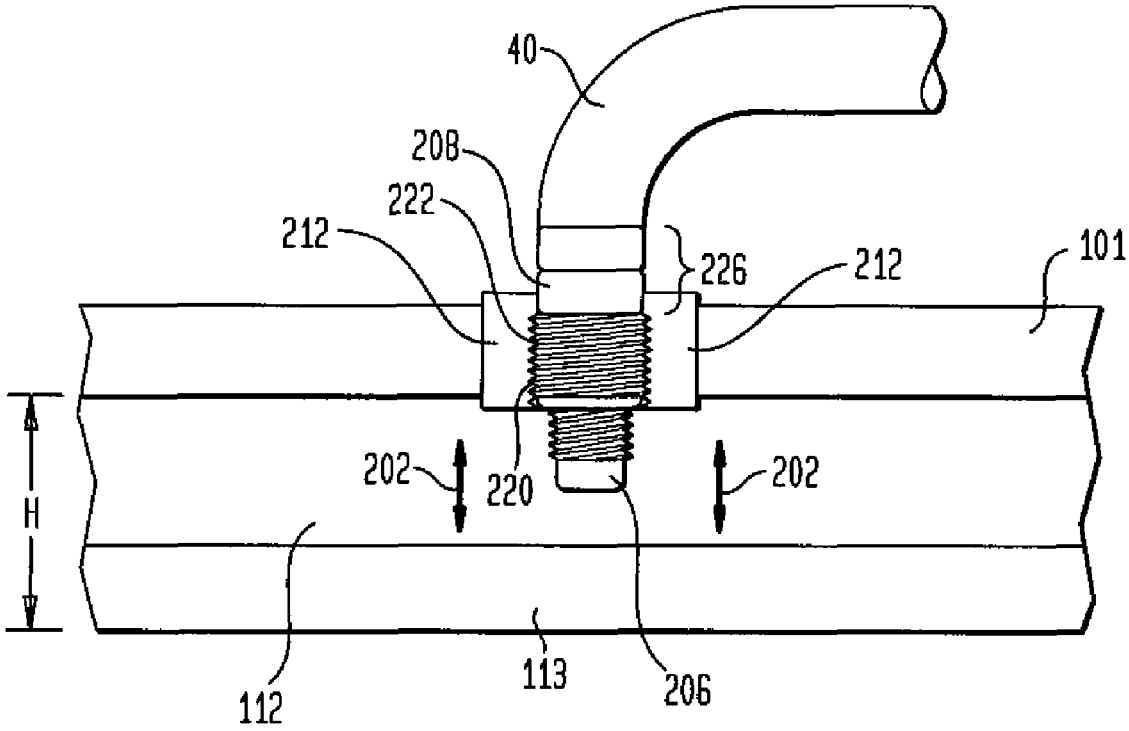
FIG. 4 is fragmentary diagrammatic sectional view of the component shown in FIGS. 1 and 2.

The squeegee structure 4 includes a single first inlet 36 and four second inlets 38. As best seen in FIGS. 2 and 3, the first inlet is disposed adjacent the rear wall 112 at a location near the center of the squeegee structure, so that the first inlet 36. The second inlets 38 are arrayed along an arc near the rear wall 112, with two second inlets 38 disposed on each side of the first inlet 36. As best seen in FIG. 4, each second inlet comprises a welded coupling member 212 with a threaded inner diameter 220, a vacuum hose attachment 208 located at the upper portion of the coupling member, a bushing member 222 with threaded exterior and interior diameters, and a short pipe section 206 of about 1.5 inch diameter. The coupling member 212 is welded to the squeegee structure. The vacuum hose attachment 208 is threadedly attached to the coupling member 222 at one end and provides a quick release mechanism of the vacuum hose at the opposite end 226. The bushing member 222 is threadedly attached to the coupling member. Pipe section 206 is threaded and open at its bottom end. Pipe section 206 is threadedly attached to the bottom, interior portion of bushing 222 so that the pipe section 206 communicates with the vacuum hose attachment 208 and vacuum hose 40. The diameter of pipe section 206 is smaller than that of the opening of the attachment 208. The length of pipe section 206 can be selectively adjusted by unthreading the pipe section from the bushing and replacing it with a different length of pipe. This adjusts the height of the pipe section bottom in the direction as indicated by arrows 202. The first inlet 36 has a similar structure, but has a larger diameter. For example, first inlet 36 may include a pipe section of about 3 inch diameter. Also, the pipe section of the first inlet may terminate at a higher elevation above the bottom edge of the rear wall 112 than the pipe sections of the second inlets.

The entire squeegee structure 4 is physically attached to the rear end of trailer frame 1 by two adjustable mounting brackets 68. The mounting brackets allow for the squeegee structure to be raised to the position indicated in broken lines at 4' in FIG. 1, lowered to the operating position, or completely removed. The squeegee structure 4 has caster wheels 50 located at the rearward side of the structure. The caster wheels 50 can pivot freely relative to the squeegee structure about vertical axes.

The apparatus further includes a fluid flow structure for carrying fluid from the inlets 36 and 38 to the collection tank 10. The fluid flow structure includes a collection chamber 42 (FIGS. 1 and 3) mounted on the top wall 101 of the squeegee structure. As best seen in FIG. 3, chamber 42 has four intake openings 52 and an outlet 34. Outlet 34 is of larger diameter than the intake openings 52. The intake openings 52 are connected by hoses 40 to the pipe sections of the second inlets 40. The outlet 34 of chamber 42 is connected by a further hose 44, of larger diameter than hoses 40, to a valve 66. Collection chamber 42 also serves as a vacuum manifold for equalizing vacuum pressure in intake openings 52. Valve 66 is connected to tank 10. The fluid flow structure also includes a hose 32 which connects the first inlet 36 of the squeegee structure to another valve 64. Valve 64 is also connected to tank 10. Hoses 32 and 44 are always attached to valves 64 and 66 respectively and typically are flexible suction hoses of the types commonly used in the septic tank cleaning industry; the hoses can be constructed of metal, plastic, rubber, or any other suitable material or combination of materials.

In operation, in a method according to one embodiment of the invention, the second or caster hitch unit 150 (FIG. 5) is installed on the trailer frame 1. The apparatus is positioned on a hard surface, such as a paved ramp or taxiway of an airport having a liquid such as deicing fluid thereon. The arm 155 of the caster hitch unit is connected to a hitch on the rear of a suitable tow vehicle. In this condition, the caster wheels 153 of the hitch unit support the front end of trailer frame 1 in a predetermined, level attitude relative to the surface. Because arm 153 is pivotable, the second hitch unit can maintain this attitude regardless of the height of the hitch on the tow vehicle. This allows for selection of tow vehicles having a wide variety of hitch heights. This is particularly useful in the environment of an airport, where many different vehicles may be available. For example, an ordinary road-going truck, an aircraft tug, a baggage cart tractor or other specialized airport equipment can be used as the tow vehicle.

The squeegee structure 4 is positioned in the operative position depicted in the drawings. When the squeegee structure is in this position, and with the trailer frame 1 in the desired level attitude, the caster wheels 50 and brackets 68 position the squeegee structure with the top wall 101 substantially parallel to the pavement surface, and with the strip 113 at the bottom edge of the rear wall 112 bearing lightly on the pavement. The suction pump 12 is actuated to create a subatmospheric pressure in tank 10. One or both of valves 64 and 66 is opened to connect selected ones of the inlets 36, 38 to the tank. When valve 66 is open, chamber 42 and second inlets 38 are connected to tank 10, whereas when valve 68 is open, first inlet 36 is connected to the tank. The tow vehicle is operated to pull the trailer frame 1 and hence squeegee structure 4 over the surface, thus moving the squeegee structure over the pavement in the forward direction, with the forward end 110 leading. As the squeegee structure advances over the pavement, the liquid on the surface tends to accumulate within the space 102, near the rear wall 112.

The suction or subatmospheric pressure in tank 10 draws air and liquid into the particular inlets which are connected to the tank. The liquid is retained in tank 10, whereas the air passes out through the pump 12. The apparatus can efficiently vacuum liquids of different depths. Normally, only the smaller second inlets 38 are connected to the suction in the tank while the squeegee structure is engaged with a shallow film or layer of liquid on the pavement, whereas only the first inlet 36 is connected to the suction in the tank while the squeegee structure is engaged with a relatively deeper liquid as, for example, about an inch or more in depth. The first inlet provides rapid pickup of deep liquid, whereas the second inlets provide efficient removal of shallower liquid. The ability to select particular inlets suitable for different conditions provides effective liquid pickup with modest suction pump power and modest fuel consumption. As noted above, the pipe sections 206 of the second inlets 38 are adjustable so that their distance from the surface can be manipulated. This feature can also be used to accommodate fluid spills of different depths. The inlets can be lowered towards the ground for use with very shallow fluid is shallow, or raised when the fluid is deeper.

Once the tank is full, as indicated by a gauge located on the tank, the fluid contents of the tank can be dumped. The fluid can be discharged through a bottom drain (not shown) on the tank. As the apparatus operates, it may collect solid debris from the surface. The debris can be removed by opening door 18 and raising the front end of the tank. Typically, the squeegee structure is removed during this process.

The first or pintle hitch unit 160 can be used during the vacuuming operation if a tow vehicle having a hitch at the right height to maintain the trailer frame in a level attitude is available. Also, the first or pintle hitch unit 160 (FIG. 6) can be used to tow the apparatus in transit between locations. In transit, the squeegee structure 4 is raised from the operative position shown to a storage position shown in broken lines at 4' in FIG. 1. Alternatively, the squeegee structure can be removed entirely and carrier on the trailer frame or in the tow vehicle.

Preferably, the components are arranged so that the apparatus can be operated entirely or partially from the cab of the towing vehicle. For example, valves 66 and 64 may be electrically, hydraulically or pneumatically actuated valves, and may be linked to a suitable actuation power source and to a remote control apparatus. Also, a power-operated mechanism (not shown) may be provided for moving the squeegee structure between the operative and storage positions, and such mechanism also may be linked to the remote control apparatus.

Numerous variations and combinations of the features discussed above can be used. For example, more than one relatively large first inlet 36 can be provided. Also, more than four or fewer than four second inlets 38 can be provided. The size and shape of the squeegee structure can be varied. Also, the squeegee structure, tank and associated elements can be mounted on a self-powered truck chassis instead of on a trailer. The hitch units can include features other than rings for engaging the hitch on the tow vehicle. For example, the ring can be replaced by a ball socket for engagement with a ball-type hitch or a pin for engagement with a "fifth wheel" type hitch.

In a further variant, the two separate hitch units can be replaced by features integrated with the trailer frame which are arranged to hold the trailer frame in a predetermined level attitude regardless of the height of the hitch on a tow vehicle. For example, a ring or other feature for engaging the tow vehicle can be mounted to the front end of the trailer frame through an adjustable mechanism such as a screw jack so that the ring or other engaging feature can be moved upwardly and downwardly relative to the trailer frame and then locked in place.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An apparatus for suctioning fluid from a hard surface comprising:

(a) a squeegee structure defining a collection space, the squeegee structure being movable across the hard surface and adapted to collect fluid from the hard surface in the collection space;

(b) a collection tank;

(c) a plurality of vacuum inlets communicating with the collection space;

(d) a fluid flow structure including one or more conduits, the fluid flow structure being constructed and arranged to connect only one or more selected ones of the inlets to the tank;

(e) a suction pump connected to the collection tank;

wherein the vacuum inlets include a first inlet and a plurality of second inlets, the fluid flow structure being constructed and arranged to selectively connect all of the second inlets to the collection tank or disconnect all of the second inlets from the collection tank, and to selectively connect or disconnect the first inlet and the collection tank;

wherein apparatus for the squeegee structure has a rear wall bounding the collection space and extending in a widthwise direction and a center point, the first inlet communicating with the collection space adjacent the center point of the rear wall, the second inlets communicating with the collection space adjacent the rear wall remote from the center point on opposite sides of the center point.

2. The apparatus as claimed in claim 1 wherein the squeegee structure has a top wall extensive in a horizontal direction.

3. The apparatus as claimed in claim 1 wherein the vacuum inlets are tubular members.

4. The apparatus as claimed in claim 1 wherein the vacuum inlets move relative to the squeegee structure.

5. The apparatus as claimed in claim 1 wherein the diameter of the first inlet is greater than the diameter of the second inlets.

6. The apparatus as claimed in claim 1 wherein the rear wall slopes in a forward direction away from the center point said squeegee structure having an opening at a forward side.

7. The apparatus as claimed in claim 6 further comprising a wheeled base, the squeegee structure being mounted to the wheeled base, the wheeled base being operable to move the squeegee structure in the forward direction.

8. The apparatus as claimed in claim 1 wherein the fluid flow structure includes a chamber for collecting fluid and connections for connecting the chamber to the tank, and connecting the second inlets to the chamber, so that fluid is transferred from second inlets, to the tank via the chamber.

9. The apparatus as claimed in claim 7 wherein the wheeled base is a self powered vehicle.

10. The apparatus as claimed in claim 7 wherein the wheeled base is a towable device.

11. The apparatus as claimed in claim 1 wherein the apparatus contains an indicator on the tank for signaling the level of fluid in the tank.

12. The apparatus as claimed in claim 1 wherein the fluid flow structure includes direct connections between second vacuum inlets and the collection tank.

* * * * *

UNITED STATES PATENT AND TRADEMARK OFFICE

CERTIFICATE OF CORRECTION

PATENT NO. : 8,365,346 B2
APPLICATION NO. : 12/316662
DATED : February 5, 2013
INVENTOR(S) : John R. Coppola and Frank G. Coppola It is certified that error appears in the above-identified patent and that said Letters Patent is hereby corrected as shown below:

In the Specification

Column 1, line 38, “include” should read --includes--
Column 1, line 65, cancel the word “a”
Column 1, line 65, after “of” insert --the present invention--
Column 2, line 3, after “one” insert --or--
Column 2, line 20, after “is” insert --a--
Column 2, line 23, after “association” insert --with--
Column 2, line 24, after “is” insert --a--
Column 2, line 59, “depicted” should read --depicted,--
Column 5, line 13, “is” should read --are--
Column 5, line 43, cancel the words “is shallow”

In the Claims

Column 7, line 9, Claim 6, “point” should read --point,--
Column 8, line 3, Claim 8, “inlet,” should read --inlet--
Column 8, line 5, Claim 9, “self powered” should read --self-powered--

Signed and Sealed this
Twenty-sixth Day of May, 2015

Michelle K. Lee

Michelle K. Lee
*Director of the United States Patent and Trademark Office*